US008191985B2

(12) United States Patent
Yamada et al.

(10) Patent No.: US 8,191,985 B2
(45) Date of Patent: Jun. 5, 2012

(54) INK JET PRINTER

(75) Inventors: Yuichi Yamada, Tokyo (JP); Tetsuaki Tokime, Hachioji (JP); Minoru Kishino, Kunitachi (JP)

(73) Assignee: Riso Kagaku Corporation, Tokyo (JP)

( * ) Notice: Subject to any disclaimer, the term of this patent is extended or adjusted under 35 U.S.C. 154(b) by 336 days.

(21) Appl. No.: 12/561,578

(22) Filed: Sep. 17, 2009

(65) Prior Publication Data

US 2010/0066785 A1 Mar. 18, 2010

(30) Foreign Application Priority Data

Sep. 18, 2008 (JP) ..... 2008-239506
Aug. 28, 2009 (JP) ..... 2009-198650

(51) Int. Cl.
*B41J 29/377* (2006.01)

(52) U.S. Cl. ..... 347/18

(58) Field of Classification Search ..... 347/17, 347/18

See application file for complete search history.

(56) References Cited

U.S. PATENT DOCUMENTS 5,486,849 A * 1/1996 Miura et al. ..... 347/18
5,936,646 A * 8/1999 Kenny et al. ..... 347/18
6,113,212 A * 9/2000 Ng ..... 347/18

FOREIGN PATENT DOCUMENTS

JP 2001-231853 A 8/2001

* cited by examiner

*Primary Examiner* — An Do
(74) *Attorney, Agent, or Firm* — Holtz, Holtz, Goodman & Chick, PC

(57) ABSTRACT

An ink jet printer printing an image using a plurality of types of color ink. The heat exchanger cools and heats the ink to adjust the temperature of the ink. The heat exchanger has a contact and separate mechanism which, for ink cooling, tightly contacts a radiation section with a heat exchange section and which, for ink heating, separates the radiation section from the heat exchange section.

20 Claims, 14 Drawing Sheets

INK JET PRINTER

CROSS-REFERENCE TO RELATED APPLICATIONS

This application is based upon and claims the benefit of priority from prior Japanese Patent Applications No. 2008-239506, filed Sep. 18, 2008; and No. 2009-198650, filed Aug. 28, 2009, the entire contents of both of which are incorporated herein by reference.

BACKGROUND OF THE INVENTION

1. Field of the Invention

The present invention relates to an ink jet printer ejecting ink to a print medium to print an image on the print medium.

2. Description of the Related Art

As an invention for temperature adjusting means for liquids, a heat exchange container is disclosed in, for example, Japanese Patent Laid-Open No. 2001-231853.

The heat exchange container has an inlet section through which a liquid flows into the container, a main body section composed of a metal shell and having an internal space through which the liquid flows, and an outlet section through which the liquid having passed through the inside of the main body section flows out of the container. One or more channel guide walls are provided inside the main body section. Thus, inside the main body section, a liquid channel along which the flow of the liquid is guided is formed by the channel guide walls. The overall length of the liquid channel is set to be larger than the longest side of the metal shell. In the heat exchange container, a temperature adjusting section such as a heat sink or a Peltier element is provided on one or both sides of the planarly spreading channel. The heat exchange container is thus configured to be able to adjust the temperature of the liquid.

BRIEF SUMMARY OF THE INVENTION

According to an embodiment of the present invention, there is provided an ink jet printer configured to perform image recording using ink of a plurality of colors, comprising: ink heads provided in correspondence to the colors of the ink; and a heat exchanger configured to adjust a temperature of the ink supplied to the ink heads, the heat exchanger including: a heat exchange section having ink flow paths which are formed inside in correspondence to the colors of the ink; a heating section configured to heat the heat exchange section; a heat radiation section configured to come into contact with the heat exchange section and to move away from the heat exchange section; and a contact and separate mechanism configured to bring the heat radiation section into contact with the heat exchange section when the heat radiation section radiates a heat of the heat exchange section, and to separate the heat radiation section from the heat exchange section and thereby form a heat conduction-blocking space between the heat radiation section and the heat exchange section, when the heating section heats the heat exchange section.

Moreover, there is provided an ink jet printer configured to perform image recording using ink of a plurality of colors, comprising: ink heads provided in correspondence to the colors of the ink; and a heat exchanger configured to adjust a temperature of the ink supplied to the ink heads, the heat exchanger including: a heat exchange section having ink flow paths which are formed inside in correspondence to the colors of the ink; a heating section configured to come into tight contact with the heat exchange section and to heat the heat exchange section; a heat radiation section located away from the heat exchange section and configured to radiate heat from the heat exchange section; a closing member configured to form a closed space between the heat exchange section and the heat radiation section; and a container communicating with the closed space and containing a fluid; and wherein the fluid is supplied into the closed space when the heat radiation section radiates a heat of the heat exchange section, and the fluid is returned from the space into the container when the heating section heats the heat exchange section.

Moreover, there is also provided an ink jet printer printing an image using a plurality of types of color ink, the ink jet printer comprising: ink heads provided in correspondence to the colors of the ink; and a heat exchanger configured to adjust a temperature of the ink supplied to the ink heads, the heat exchanger including: a heat exchange section internally having ink channels formed independently for the respective ink colors; and a heat sink tightly contacting the heat exchange section and having a plurality of fins extended in a direction in which the fins traverse the ink channels for the respective colors.

Advantages of the invention will be set forth in the description which follows, and in part will be obvious from the description, or may be learned by practice of the invention. Advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be described below with reference to the drawings.

Figure 1:
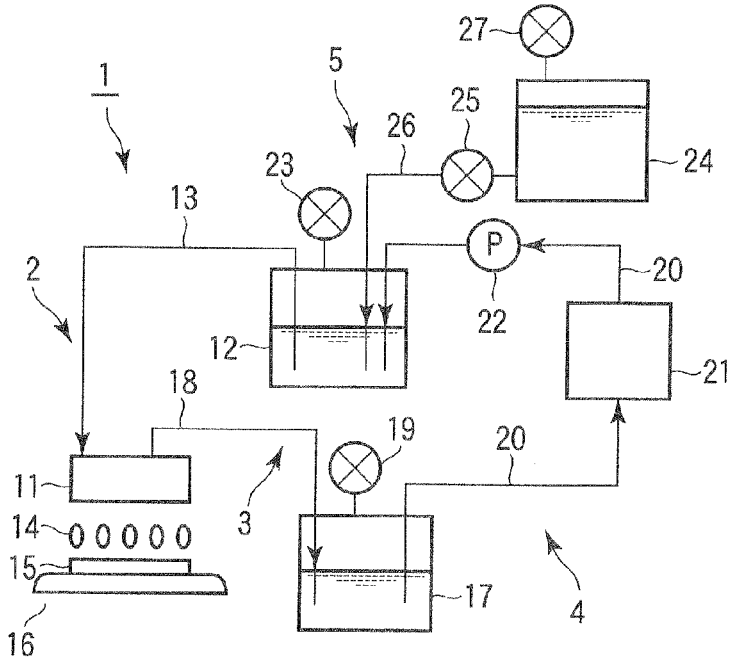
FIG. 1 is a block diagram showing a conceptual configuration example of an ink path in an ink jet printer in which a heat exchanger according to a first embodiment is mounted.

FIG. 1 is a block diagram showing a conceptual configuration of an ink path in an ink jet printer in which a heat exchanger according to a first embodiment is mounted. The ink jet printer is an image recording apparatus using four types of color ink [the colors are cyan: C, magenta: M, yellow: Y, and black: K] to form images. Thus, the ink jet printer has four independent ink paths for the respective types of ink. As described below in detail, a heat exchanger 21 is used for all of the four types of color ink. FIG. 1 shows the configuration of an ink path for one type of color ink.

As shown in FIG. 1, the ink path in the ink jet printer has an ink circulating section 1 and an ink refilling section 5.

First, the ink circulating section 1 will be described.

The ink circulating section 1 has an ink supply section 2, an ink discharge section 3, an ink return section 4, and a printing section 11.

The ink supply section 2 is composed of a first tank 12 and a supply tube 13. Ink in the first tank 12 is fed to the printing section 11 via the supply tube 13. The first tank 12 includes an air open section (solenoid valve) 23 that enables the inside of the first tank 12 to be opened to and shut off from the air, and a level detector (not shown in the drawings) that detect an amount of ink in the first tank 12. In the present embodiment, the first tank 12 is located above the printing section 11 in the direction of gravity.

The printing section 11 has an ink head that ejects ink. The printing section 11 drives the ink head based on an input image signal (image data). The ink head ejects droplets of ink 14 to the print medium 15 conveyed by a conveying mechanism 16. Thus, an image is printed on the print medium 15.

The ink discharge section 3 is composed of a second tank 17 and a discharge tube 18. The second tank 17 collects, via a discharge tube 18, ink having not ejected by the printing section 11. The second tank 17 includes an air open section (solenoid valve) 19 that enables the inside of the second tank 17 to be opened to and shut off from the air, and a level detector (not shown in the drawings) that detect an amount of ink in the second tank 17. In the present embodiment, the second tank 17 is located below the printing section 11 in the direction of gravity.

The ink return section 4 is composed of a return tube 20, the heat exchanger 21, and a pump 22. The return tube 20 is a path connecting the first tank 12 and the second tank 17. The heat exchanger 21 and the pump 24 are arranged in the path of the return tube 20. Since the heat exchanger 21 is used for all of the four types of color ink, an ink channel is provided for each of the ink colors, as described below in detail. If four types of color ink are used as in the case of the present embodiment, the heat exchanger 21 includes four independent ink channels. The pump 22 feeds (returns) the ink in the second tank 17 to the first tank 12.

Now, the ink refilling section 5 will be described.

The ink refilling section 5 is composed of a main tank (or a removable ink cartridge) 24 and a refilling tube 26. Ink in a predetermined color is stored in the main tank 24. The main tank 24 includes an air open section (solenoid valve) 27 that enables the inside of the main tank 24 to be opened to and shut off from the air. The refilling tube 26 extends from the main tank 24 and is connected to the first tank 12 via the solenoid valve 25. The main tank 24 allows ink to be refilled into the first tank 12 if an amount of ink in the ink circulating section 1 is equal to or smaller than a prescribed value. In the present embodiment, the ink refilling section 5 is connected to the first tank 12. However, the ink refilling section 5 may be connected to the second tank 17.

In this ink jet printer, the ink circulating section 1 circulates ink at least during image printing. That is, the ink is fed from the first tank 12 to the printing section 11. The ink having not ejected by the printing section 11 returns to the first tank 12 through the second tank 17, the heat exchanger 21, and the pump 22. At this time, the solenoid valve 23 is open, while the solenoid valve 19 is closed. During non-image-printing, the solenoid valve 23 is closed, while the solenoid valve 19 is open.

Furthermore, if the amount of ink in the ink circulating section 1 decreases as a result of ink ejection, the solenoid valve 27 and the solenoid valve 25 are appropriately opened and closed. Thus, the ink in the main tank 24 is fed to the first tank 12.

In the present embodiment, ink flows through a path from the first tank 12 to the second tank 17 because of the weight of the ink associated with gravity. Thus, on the ink circulating section 1, the second tank 17, the printing section 11, and the first tank 12 are arranged in this order from the lowest position. The heat exchanger 21 and the pump 22 may be located at any heights included in the ranges of heights at which the ink can be pumped up.

Here, if the ink jet printer uses four types of color ink as in the case of the present embodiment, the four types of color ink have similar physical properties. Thus, it is desirable for the four types of color ink are substantially at the same temperature. Thus, in the present embodiment, the single heat exchanger 21 sets the temperatures of the four types of color ink to substantially the same value. Temperature sensor is provided in the ink circulating section 1 to detect the temperature of the ink. The temperature sensor is desirably provided in or near the corresponding ink head.

Now, the heat exchanger 21 according to the present embodiment will be described.

Figure 2A:
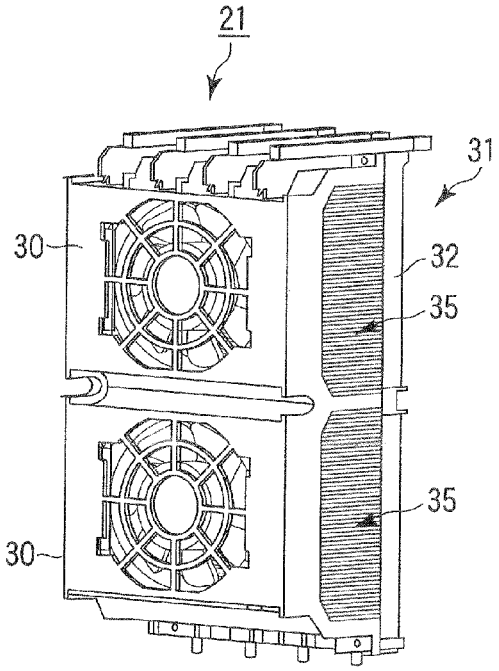
FIG. 2A is a perspective view showing the external configuration of the heat exchanger.
Figure 2B:
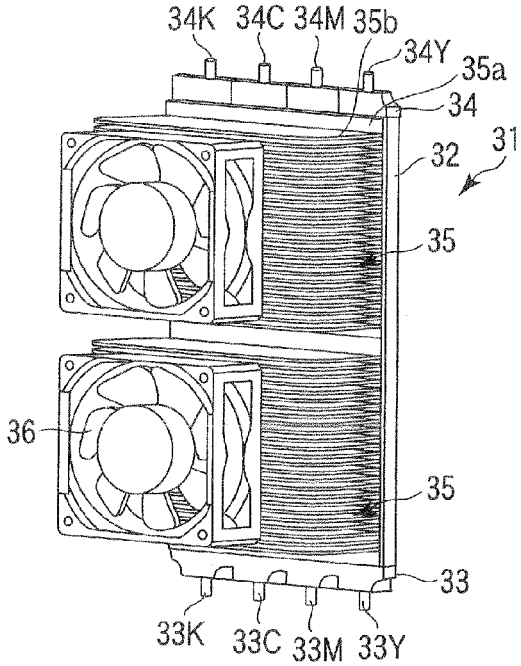
FIG. 2B is a perspective view showing the external configuration of the heat exchanger shown in FIG. 2A and from which a cover has been removed.
Figure 3:
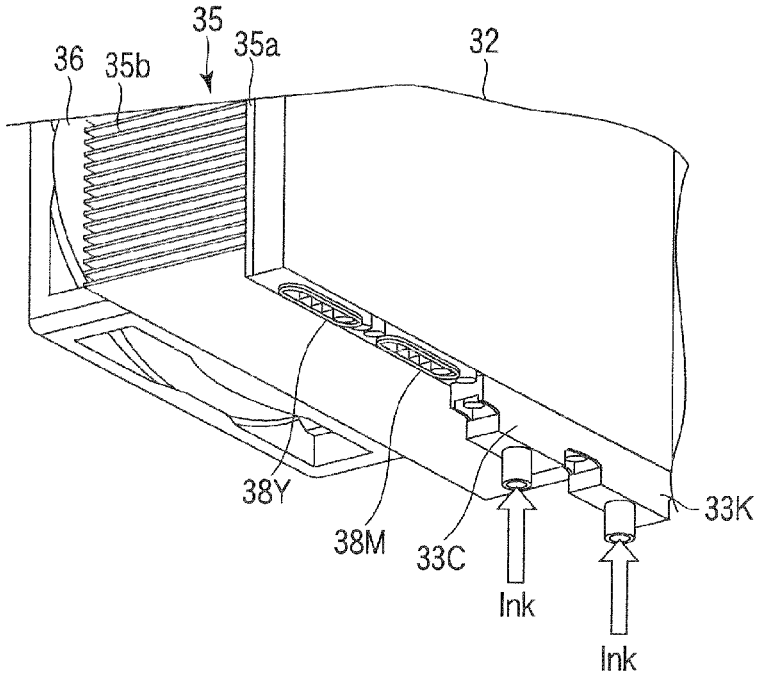
FIG. 3 is an enlarged view of the external configuration of the periphery of an ink inflow member of the heat exchanger.
Figure 4:
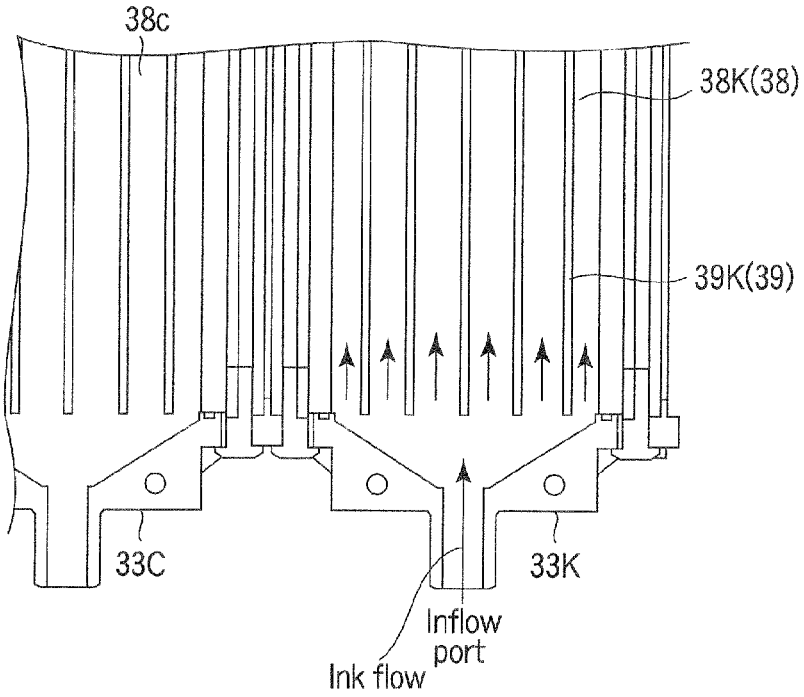
FIG. 4 is a diagram showing a sectional configuration showing ink channels inside a heat exchange section.

FIG. 2A is a perspective view showing the external configuration of the heat exchanger 21. FIG. 2B is a perspective view showing the external configuration of the heat exchanger shown in FIG. 2A and from which a cover has been removed. FIG. 3 is an enlarged view of the external configuration of the periphery of an ink inflow member of the heat exchanger. FIG. 4 is a diagram showing a sectional configuration showing an ink channel inside a heat exchange section. In the ink circulating section 1, heat generated by, for example, driving of the ink heads may increase the temperature of the circulating ink. Thus, the heat exchanger 21 according to the present embodiment provides the cooling function of reducing the ink temperature.

As shown in FIGS. 2A and 2B, the heat exchanger 21 is composed of a heat exchange section 32, a heat sink 35 serving as a heat radiation section, and a cooling fan 36. A cover 30 is mounted on the heat exchanger 21.

An ink inflow member 33 (33K, 33C, 33M, and 33Y) is attached to the heat exchange section 32 to allow ink in each ink color to flow into the heat exchange section 32. An ink outflow member 34 (34K, 34C, 34M, and 34Y) is attached to the heat exchange section 32 to allow ink in each ink color to flow out from the heat exchange section 32. The ink inflow member 33 and the ink outflow member 34 may be molded integrally with the heat exchange section 32.

Furthermore, as shown in FIGS. 3 and 4, an ink channel (38K, 38C, 38M, and 38Y) separated into portions for the respective ink colors is formed inside the heat exchange section 32. The heat exchange section 32 is formed of metal. More specifically, the heat exchange section 32 is formed of a material with a high heat conductivity such as aluminum or copper. When the heat exchange section 32 is formed of the material with a high heat conductivity, the different types of ink flowing through the respective ink channels 38 in the heat exchange section 32 efficiently exchange heat with one another. FIG. 4 typically shows the ink inflow member 33K and ink channel 38K for the corresponding color. FIG. 4 shows the ink channel 38K for ink flowing in through the ink inflow member 33K. However, each of the ink channels for the other colors has a similar configuration.

The ink channel 38K in the heat exchange section 32 is partitioned by a plurality of walls 39K extending parallel to one another from the ink inflow member 33K toward the ink outflow member 34K. The heat sink 35 is attached tightly to one surface of the heat exchange section 32.

The ink channel 38 in the present embodiment is divided by the plurality of walls 39 into small channels extending parallel to one another. Thus, the ink channel 38 has an increased area in which the ink channel 38 contacts ink. The ink channel 38 is not limited to this aspect provided that the ink channel 38 is shaped to have an increased area in which the ink channel 38 contacts ink.

In this configuration, ink flows in through an inflow port of the ink inflow member 33K. The ink then passes through the small channels of ink channel 38K partitioned by the plurality of walls 39. Then, in the ink outflow member 34K, the ink is collected in a funnel form and then flows out through an outflow port. The ink flowing out through the ink outflow member 34K flows to the first tank 12. The ink outflow member 34K is configured similarly to the ink inflow member 33K.

The heat sink 35 is composed of a base material 35*a* and a plurality of fins 35*b* formed on the base material 35*a*. The base material 35*a* is in tight contact with one surface of the heat exchange section 32. Furthermore, as shown in FIGS. 2B and 3, the plurality of fins 35*b* extend in a direction traversing the ink channels 38 for the respective colors in the heat exchange section 32. With this arrangement, if for example, the temperature of the ink in the ink channel 38K becomes higher than those of the ink in the ink channels 38C, 38M, and 38Y, the ink in the ink channels 38C, 38M, and 38Y further efficiently reduces the temperature of the ink in the ink channel 38K via the plurality of fins 35*b*. That is, since the fins 35*b* are extended in the direction traversing the ink channels 38 for the respective colors in the heat exchange section 32, heat exchange can be efficiently performed on the ink channels 38 for the respective colors.

Although not shown in the drawings, for example, a member with a high heat conductivity such as silicon may be interposed between the heat exchange section 32 and the heat sink 35 (base material 35*a*) in order to improve the heat conductivity of the heat exchanger. Moreover, the heat exchange section 32 may be molded integrally with the heat sink 35 into a single member instead of being assembled with the separate heat sink 35. The integration eliminates the interface portion between the heat exchange section 32 and the heat sink 35, improving heat exchange efficiency. That is, cooling efficiency is further improved.

A cooling fan is 36 is provided on the tip side of the fins 35*b* of the heat sink 35. The cooling fan 36 blows air against the fins 35*b*. Thus, the cooling fan 36 cools the heat sink 35. The cooling fan 36 is driven when the above-described temperature sensor detects that the temperature of the ink has risen at least larger than a set value and is stopped when the temperature sensor detects that the temperature of the ink has lowered to a set value. Thus, to cool the ink, the heat of the color ink is conducted to the heat sink 35 (fins 35*b*) through the ink channel 38 in the heat exchange section 32. Then, the cooling fan 36 discharges the heat to the air. The cooling fan 36 is attached to the cover 30.

As described above, in the heat exchanger according to the present embodiment, the plurality of fans 35*b* of the heat sink 35 are extended in the direction traversing the ink channels 38 for the respective colors in the heat exchange section 32. Thus, heat exchange can be efficiently performed on the ink channels for the four colors. That is, the heat exchanger is simply configured to allow the temperatures of the four types of color ink to be kept at substantially the same value while saving power. Consequently, the ink jet printer can print images at the optimum ink temperature. In the description of the present embodiment, the ink jet printer is of a type that circulates ink. However, the present invention is applicable to ink jet printers of a type that does not circulate ink, and even in this case, can still exert equivalent effects.

Now, a second embodiment will be described.

Figure 5:
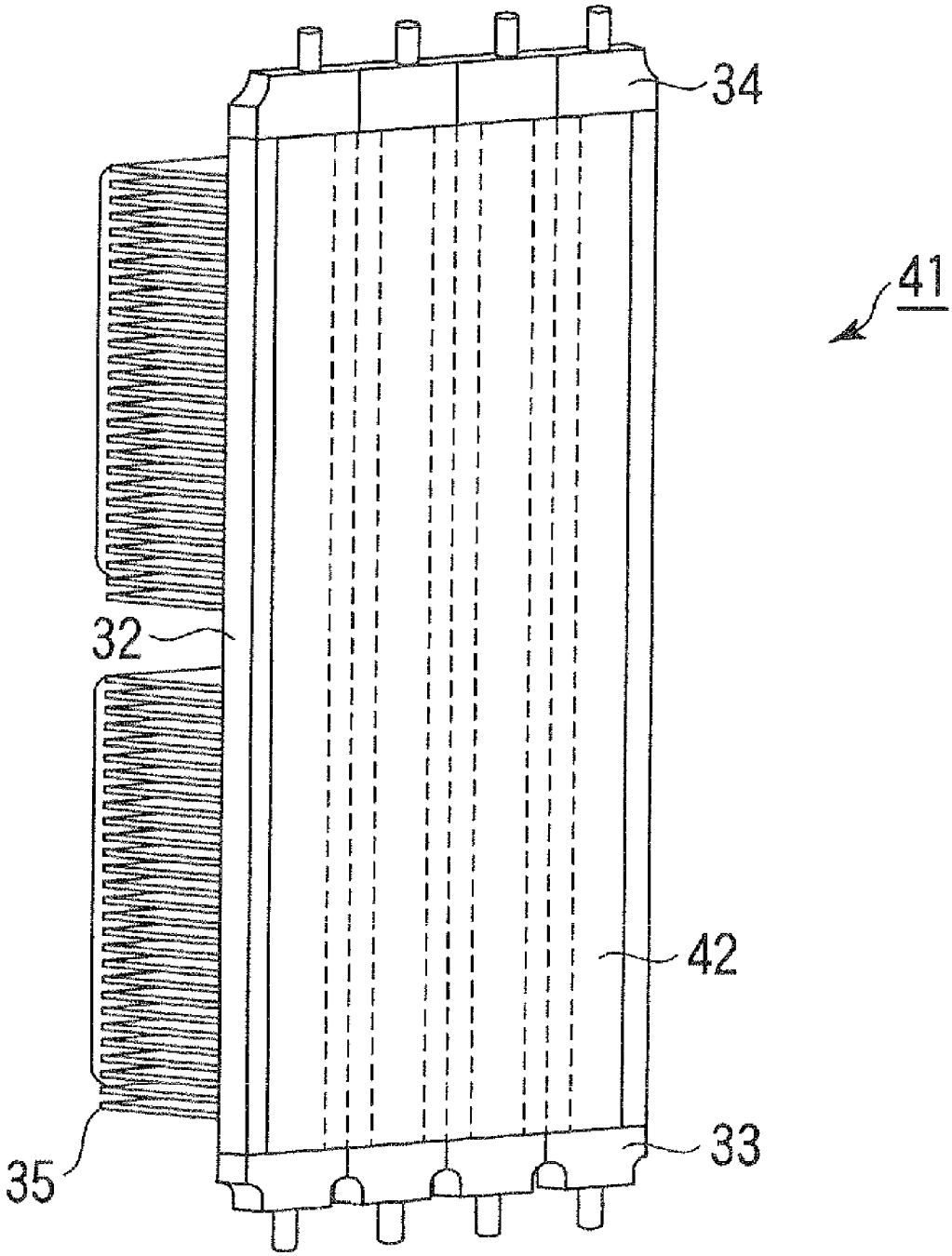
FIG. 5 is a diagram showing the external configuration of a heat exchanger according to a second embodiment.
Figure 6A:
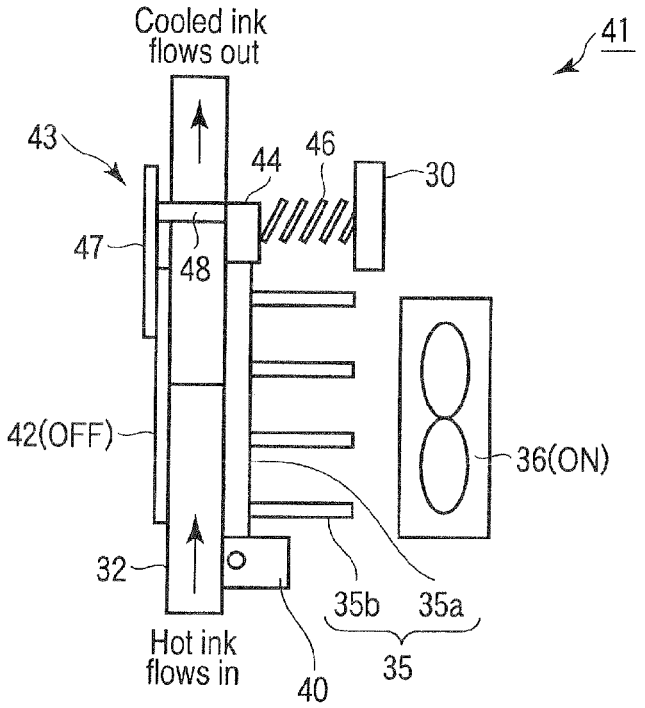
FIG. 6A is a diagram showing an operational condition in a configuration of the heat exchanger according to the second embodiment during radiation.
Figure 6B:
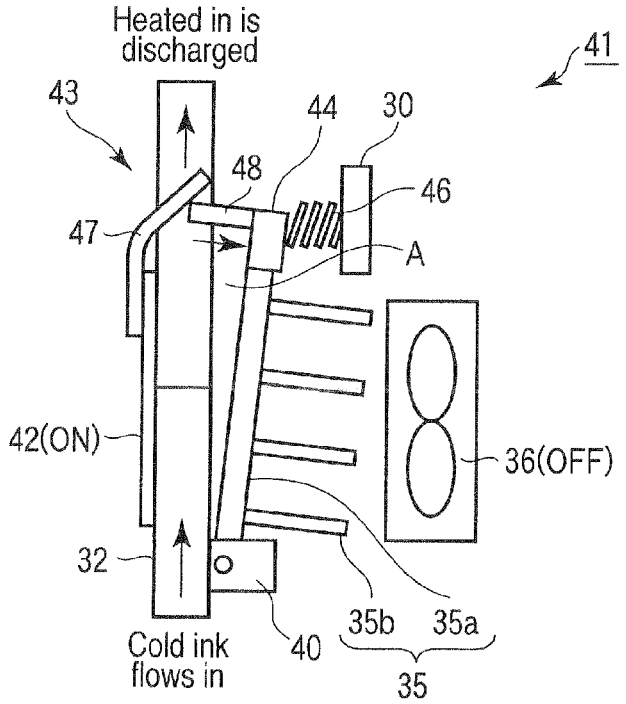
FIG. 6B is a diagram showing an operational condition in the configuration of the heat exchanger according to the second embodiment during heating.

FIG. 5 is a diagram showing the external configuration of a heat exchanger according to the second embodiment. FIGS. 6A and 6B are diagrams showing the operational condition of a contact and separate mechanism.

For example, when the ink jet printer is started after a long halt condition, the temperature of the ink may be lower than a value appropriate for image printing. Thus, although the heat exchanger according to the above-described first embodiment provides only the function of cooling ink, the heat exchanger according to the present embodiment additionally provides the function of heating ink.

As shown in FIGS. 5, 6A, and 6B, a heat exchanger 41 according to the present embodiment includes a heater 42 serving as a heating section and a contact and separate mechanism 43; the heater 42 is provided on a surface of the heat exchange section 32 located opposite the side surface on which the heat sink 35 serving as a heat radiation section of the heat exchange section 32 is provided. The other components are equivalent to those of the above-described first embodiment.

In the heat exchanger 41 according to the present embodiment, the heat sink 35 is configured to be able to contact and separate the heat exchange section 32. Specifically, one end side of the base material 35*a* is supported by a support member 40 so as to be pivotally movable. Thus, the base material 35*a* moves rotationally to a contact position where the base material 35*a* contacts the heat exchange section 32 (FIG. 6A) or to a non-contact position where the base material 35*a* separates from the heat exchange section 32 (FIG. 6B). In the present embodiment, the support member 40 is provided on the cover 30.

The contact and separate mechanism 43 includes a spring receiving section 44, an interposition section 48, a bias spring 46 serving as a bias member, and a contact and separate member 47.

The spring receiving section 44 is provided at the other end of the base material 35*a*. One end side of the spring 46 is in contact with the spring receiving section 44. The other end side of the spring 46 is attached to, for example, the cover 30 to press the spring receiving section 44 against the heat exchange section 32. That is, the spring 46 biases the base material 35*a* via the spring receiving section 44 in a direction in which the base material 35*a* comes into tight contact with the heat exchange section 32.

The interposition member 48 is provided on the back surface side (which is located opposite the surface against which the spring abuts) of the spring receiving section 44. The interposition member 48 extends toward the contact and separate member 47 as described below. That is, one end side of the interposition member 48 is fixed to the back surface of the spring receiving section 44. The other end side of the interposition member 48 abuts against the contact and separate member 47.

The contact and separate member 47 is a displacement member that changes its shape in accordance with a temperature. The contact and separate member 47 is made of a shape memory alloy or a bimetal, for example. One end side of the contact and separate member 47 abuts against the interposition member 48. The other end side of the contact and separate member 47 contacts at least one of the heater 42 and the heat exchange section 32 directly or via a heat conduction member. In the present embodiment, the contact and separate member 47 is configured to contact the heater 42.

If the heat exchanger 41 functions to cool ink, the heater 42 is powered off and the cooling fan 36 is powered on so that the cooling fan 36 provides cooling. In this case, as shown in FIG. 6A, the low temperature of the heater 42 causes the contact and separate member 47 to extend linearly. The state in which the contact and separate member 47 is at the time will be referred to as a first state. Thus, the base material 35*a* is biased by the spring 46 so as to come into tight contact with the heat exchange section 32. Consequently, the heat of hot ink is conducted from the heat exchange section 32 to the heat sink 35 for radiation. The radiation lowers the temperature of the ink, which is thus cooled down to a desired ink temperature.

Furthermore, if the heat exchanger 41 functions to heat ink, the heater 42 is powered on and the cooling fan 36 is powered off so that the heater 42 provides heating. In this case, as shown in FIG. 6B, the contact and separate member 47 is bent by the heating by the heater 42. The state in which the contact and separate member 47 is at the time will be referred to as a second state. The contact and separate member 47 is bent in a direction in which the interposition member 48 is pressed forward to separate the base material 35*a* from the heat exchange section 32.

Thus, when shape changes the contact and separate member 47, the base material 35*a* pivotally move one end side as a center. The base material 35*a* thus separates from the heat exchange section 32. Consequently, a space A is formed between the base material 35*a* and the heat exchange section 32. The space A is an air layer that can block heat conduction and prevent heat from the heater 42 from being radiated from the heat sink 35. This allows ink to be efficiently heated by the heater 42. When the heater 42 is turned off, the contact and separate member 47 returns into the state shown in FIG. 6A.

As described above, while the heater 42 is not providing heating, the contact and separate member 47 is prevented from being deformed. The base material 35*a* is biased by the spring 46 and pressed against the heat exchange section 32. The base material 35*a* thus comes into tight contact with the heat exchange section 32 and is set to a cooled condition. In the cooled condition, the heat sink 35 can radiate the heat of the ink conducted from the heat exchange section 32. Furthermore, if the heater 42 provides heating, heat from the heater 42 deforms the contact and separate member 47. The base material 35*a* thus separates from the heat exchange section 32 against the bias force of the spring 46 and is set to a heated condition. In the heated condition, the space A including the air layer producing a heat insulation effect is formed between the base material 35*a* and the heat exchange section 32. Thus, the heating by the heater 42 is prevented from being conducted to the heat sink 35. Consequently, the heater 42 can efficiently heat the heat exchange section 32 to increase the temperature of ink. As described above, the heat exchanger according to the present embodiment is simply configured to allow the temperatures of the four types of color ink to be efficiently kept at substantially the same value while saving power.

In the present embodiment, the combination of the heat sink 35 and the cooling fan 36 is described as a method for cooling ink, by way of example. However, the present invention is not limited to this aspect. For example, water cooling may be used, or instead of water, a refrigerant used for air conditioners may be used.

Furthermore, in the present embodiment, the interposition member 48 is fixed to the spring receiving section 44 and abuts against the contact and separate member 47. In contrast, the interposition member 48 may be fixed to the contact and separate member 47 and abut against the spring receiving section 44. Alternatively, the interposition member 48 may be fixed to both the spring receiving section 44 and the contact and separate member 47.

Additionally, in the present embodiment, the contact and separate member 47 changes from the linear shape to an L shape. However, for example, the contact and separate member 47 may usually have a Z shape and be elongated when thermally deformed.

Furthermore, in order to propose a simple configuration, the present embodiment uses the contact and separate member composed of the shape memory alloy (or the bimetal structure) as a mechanism for separating the heat sink 35. Of course, the present invention is not limited to this aspect. Various mechanisms are possible including, for example, a contact and separate mechanism that electrically bends a contact and separate member formed of a piezoelectric member to separate the heat sink 35, a contact and separate mechanism that uses an electromagnet to separate the heat sink 35 by magnetic force, and a contact and separate mechanism that uses a combination of a motor and an elliptic pulley to rotate the pulley to separate the heat sink 35.

Now, a modification of the second embodiment will be described.

Figure 7B:
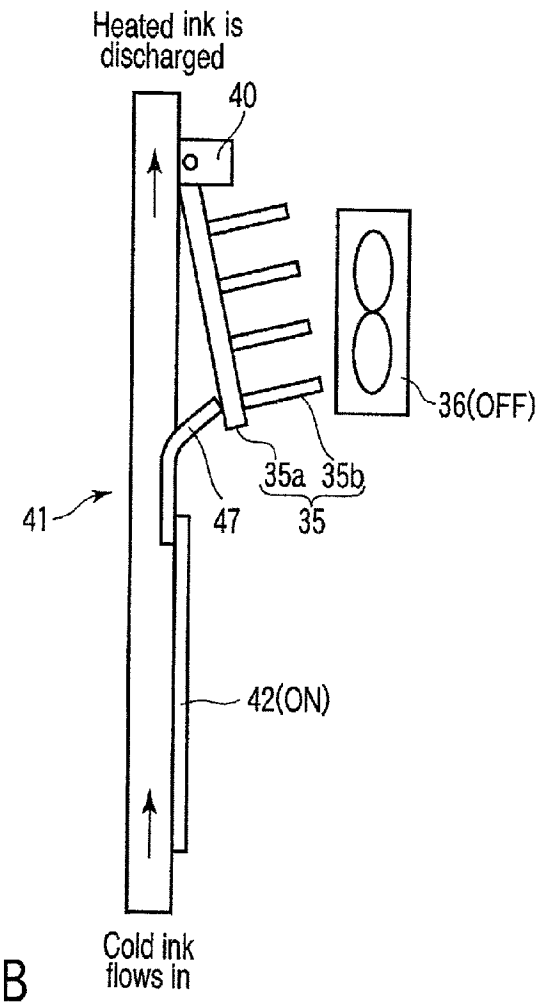
FIG. 7B is a diagram showing an operational condition in the configuration of the heat exchanger according to the modification of the second embodiment during heating.
Figure 7A:
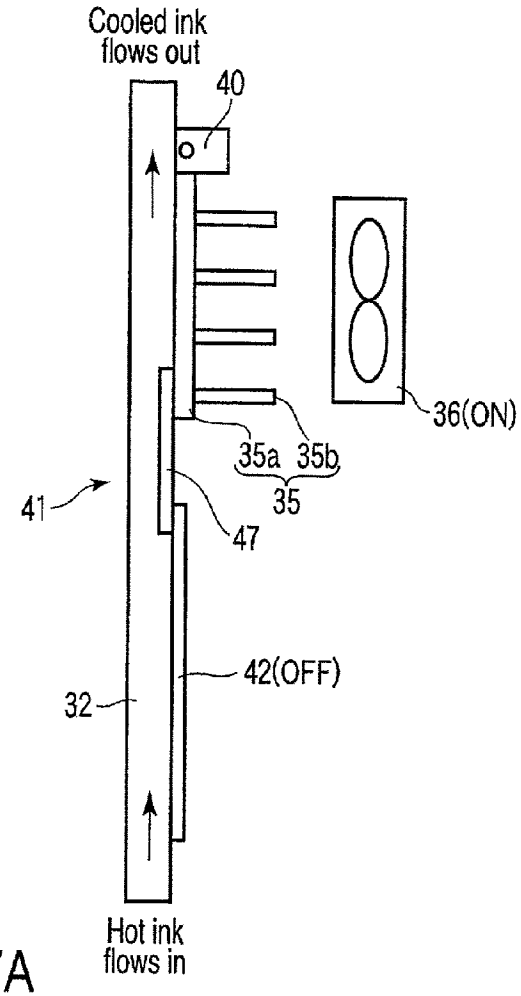
FIG. 7A is a diagram showing an operational condition in a configuration of a heat exchanger according to a modification of the second embodiment during radiation.

FIGS. 7A and 7B are diagrams showing the configuration of a heat exchanger according to the modification of the second embodiment. FIG. 7A shows an operational condition during cooling (radiation). FIG. 7B shows an operational condition during heating. Components of the modification which are equivalent to those of the above-described second embodiment are denoted by the same reference numerals and will not be described below. Furthermore, the spring receiving section 44 and the spring 46 are omitted from FIGS. 7A and 7B.

The heat exchanger 41 according to the modification is configured such that the heat sink 35, the contact and separate member 47, and the heater 42 are arranged on one surface of the heat exchange section 32. The contact and separate member 47 is similar to that in the above-described second embodiment. Thus, if hot ink flows into the heat exchanger, the cooling fan 36 is powered on and the heater 42 is power off so that the base material 35*a* of the heat sink 35 comes into tight contact with the heat exchange section 32 as shown in FIG. 7A. On the other hand, if cold ink flows into the heat exchanger, the cooling fan 36 is powered off and the heater 42 is power on so that the contact and separate member 47 is bent to push up the base material 35*a* from the back surface side. The pushup prevents the heat sink 35 from radiating heat during heating, thus allowing ink to be efficiently heated. The temperature of the ink thus rises.

Now, a third embodiment will be described.

Figure 8B:
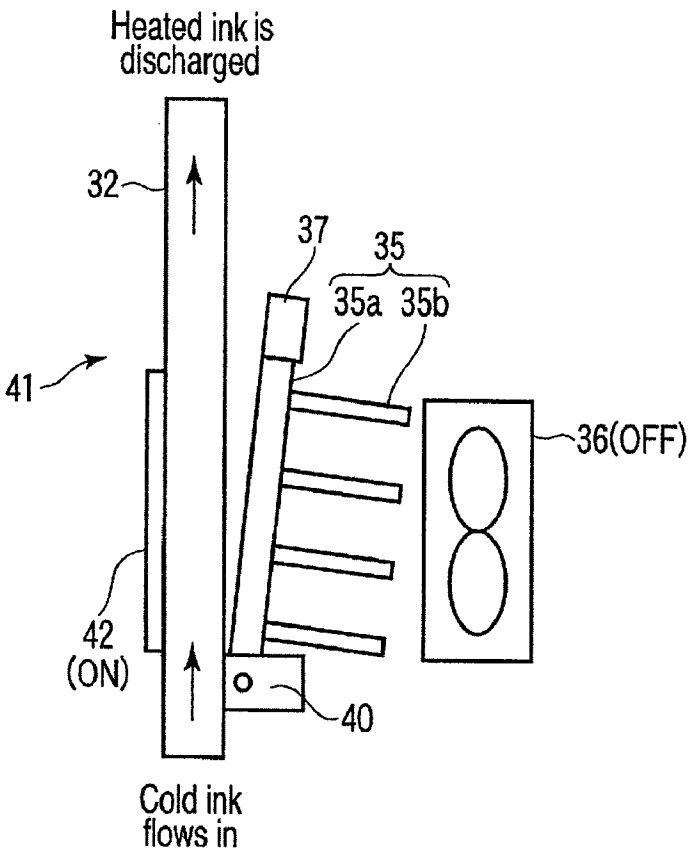
FIG. 8B is a diagram showing an operational condition in the configuration of the heat exchanger according to the third embodiment during heating.
Figure 8A:
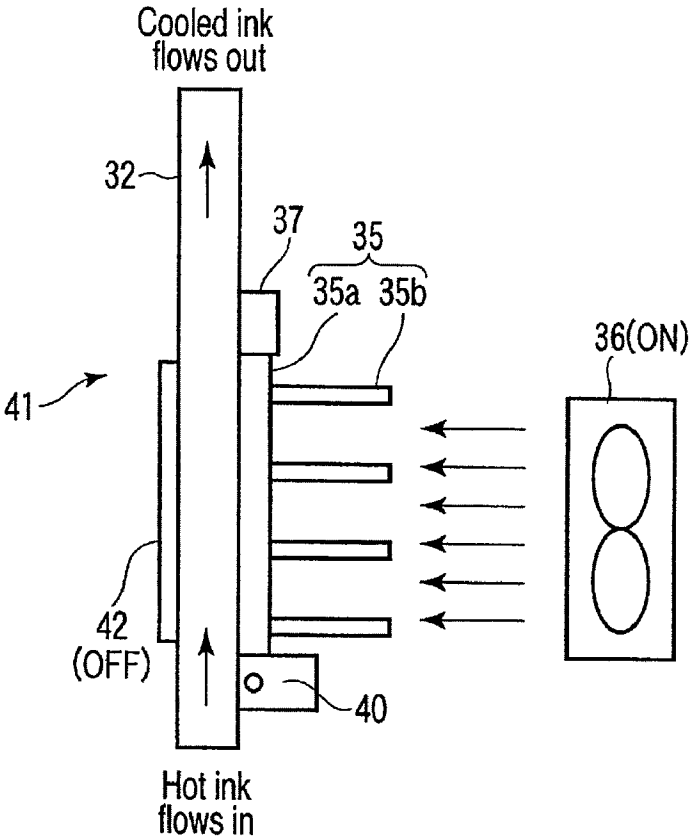
FIG. 8A is a diagram showing an operational condition in a configuration of a heat exchanger according to a third embodiment during radiation.

FIGS. 8A and 8B are diagrams showing the configuration of a heat exchanger according to the third embodiment. FIG. 8A shows an operational condition during radiation. FIG. 8B shows an operational condition during heating. Components of the present embodiment which are equivalent to those of the above-described second embodiment are denoted by the same reference numerals and will not be described below.

A contact and separate mechanism according to the third embodiment includes a balancer 37 and the cooling fan 36.

As shown in FIG. 8A, the heater 42 is located on one surface of the heat exchange section 32, with the heat sink 35 located on the opposite surface. One end side of the base material 35*a* is supported by the support member 40 so as to be pivotally movable. The balancer 37 is provided on the other end side of the base material 35*a*. Since the balancer 37 is provided, in a normal condition, the heat sink 35 (base material 35*a*) is obliquely placed so as to separate from the heat exchange section 32 as shown in FIG. 8B.

As shown in FIG. 8A, for ink cooling, the heater 42 is powered off, and the cooling fan 36 is powered on. The heat sink 35 is subjected to a wind force resulting from a blast from the cooling fan 36, to come into tight contact with the heat exchange section 32. Then, the heat of hot ink is conducted from the heat exchange section 32 to the heat sink 35 for radiation. The radiation cools the ink down to the desired ink temperature.

As shown in FIG. 8B, for ink heating, the heater 42 is powered on, and the cooling fan is powered off. Since the fan 36 is stopped, the heat sink 35 separates from the heat exchange section 32. Thus, heat from the heater 42 is conducted through the heat exchange section 32 to the cold ink, which is then heated. The heating thus increases the temperature of the ink up to the desired value. In this case, since the heat sink 35 is separate from the heat exchange section 32, the air layer formed between the heat sink 35 and the heat exchange section 32 enables the heat from the heater 42 to be prevented from being radiated from the heat sink 35.

As described above, in the present embodiment, the cooling fan 36 is powered on and off to contact and separate the heat sink 35 with and from the heat exchange section 32. Thus, the temperature of ink can be efficiently adjusted.

Now, a fourth embodiment will be described.

Figure 9B:
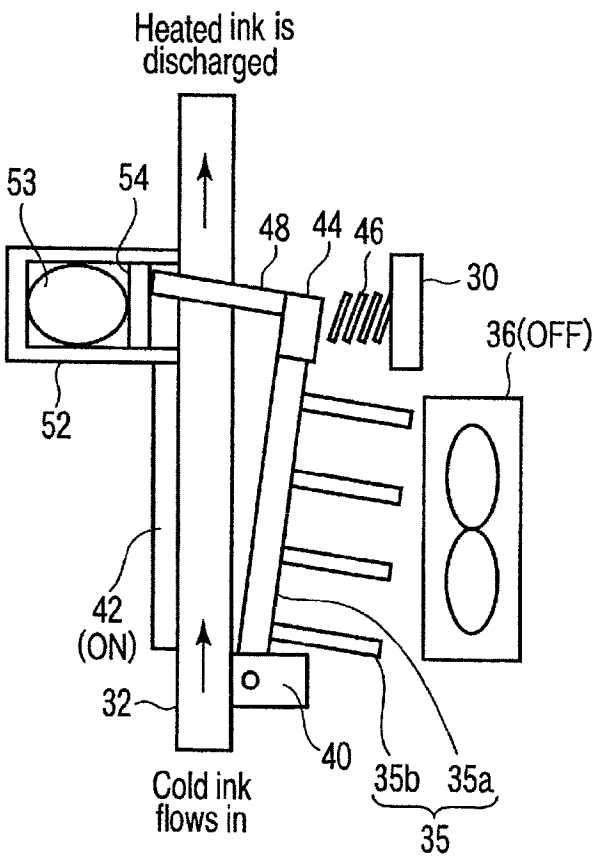
FIG. 9B is a diagram showing an operational condition in the configuration of the heat exchanger according to the fourth embodiment during heating.
Figure 9A:
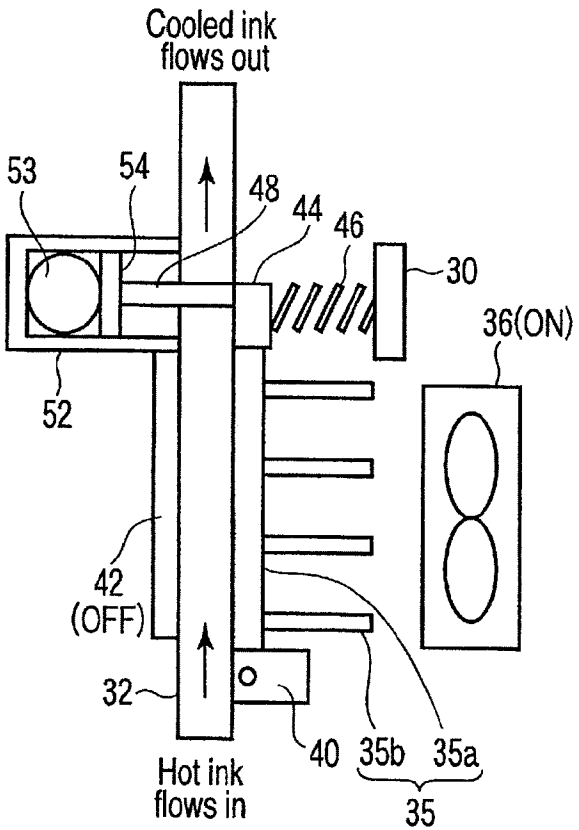
FIG. 9A is a diagram showing an operational condition in a configuration of a heat exchanger according to a fourth embodiment during radiation.

FIGS. 9A and 9B are diagrams showing the configuration of a heat exchanger according to the fourth embodiment. FIG. 9A shows an operational condition during radiation. FIG. 9B shows an operational condition during heating. Components of the present embodiment which are equivalent to those of the above-described second embodiment are denoted by the same reference numerals and will not be described below.

As shown in FIG. 9A, a contact and separate mechanism according to the fourth embodiment includes a closed container 52, an expansion section 53, a moving wall 54, a spring receiving section 44, an interposition member 48, and a bias spring 46. The expansion section 53 is a displacement member that changes its shape in accordance with a temperature.

The closed container 52 contacts the heater 42 directly or via a heat conduction member. The closed container 52 is composed of a material with a high heat conductivity. The expansion section 53 is accommodated in the closed container 52. The expansion section 53 is composed of an elastic member in which gas is contained. That is, the expansion section 53 is expanded and contracted by thermal expansion of gas. The moving wall 54 is movably accommodated in the closed container 52. One surface of the moving wall 54 abuts against the interposition member 48. Thus, the moving wall 54 presses the expansion section 53 via the spring 46.

As shown in FIG. 9A, for ink cooling, the heater 42 is powered off, and the fan 36 is powered on. In this case, the heat sink 35 is in tight contact with the heat exchange section 32. Thus, the heat of hot ink is conducted from the heat exchange section 32 to the heat sink 35 for radiation. The radiation cools the ink down to the desired ink temperature.

As shown in FIG. 9B, for ink heating, the heater 42 is powered on, and the cooling fan is powered off. At this time, heat from the heater 42 heats the closed container 52 to expand the expansion section 53. The expansion moves the moving wall 54 rightward in FIG. 9B to push out the interposition member 48. The state in which the expansion section 53 is at the time will be referred to as the second state. The push-out separates the heat sink 35 from the heat exchange section 32 to form an air layer between the heat sink 35 and the heat exchange section 31. The heat from the heater 42 efficiently heats ink without being radiated by the heat sink 35. The heating increases the temperature of the ink up to the desired value.

When the heater 42 is turned off, the temperature decreases, and the expansion section 53 shrinks. As a result, the expansion section 53 returns into the state shown in FIG. 9A. The state in which the expansion section 53 is at the time will be referred to as the first state.

As described above, according to the present embodiment, the heater 42 is powered on and off to contact and separate the heat sink 35 with and from the heat exchange section 32. The temperature of ink is thus efficiently adjusted.

Now, a fifth embodiment will be described.

Figure 10B:
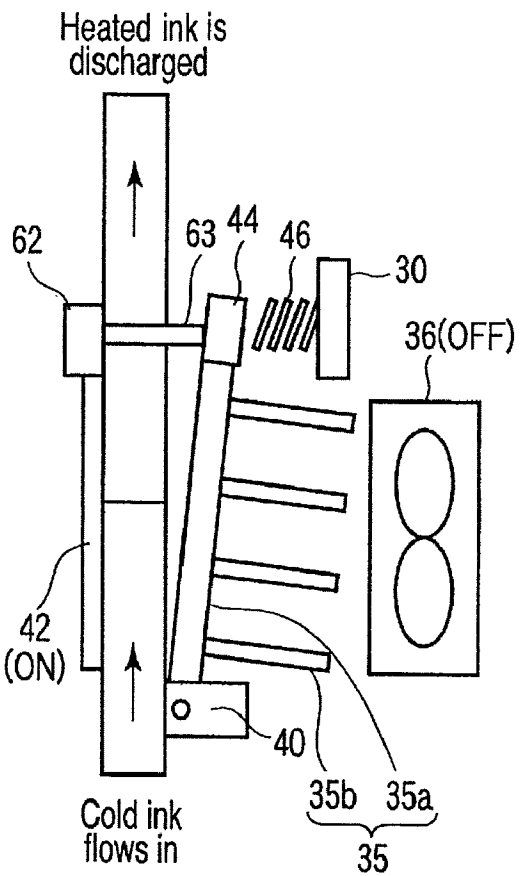
FIG. 10B is a diagram showing an operational condition in the configuration of the heat exchanger according to the fifth embodiment during heating.
Figure 10A:
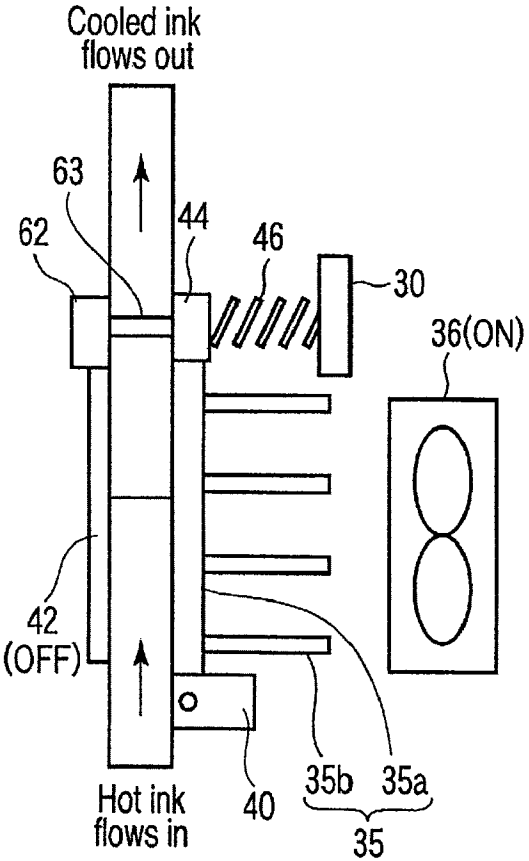
FIG. 10A is a diagram showing an operational condition in a configuration of a heat exchanger according to a fifth embodiment during radiation.

FIGS. 10A and 10B are diagrams showing the configuration of a heat exchanger according to the fifth embodiment. FIG. 10A shows an operational condition during radiation. FIG. 10B shows an operational condition during heating. Components of the present embodiment which are equivalent to those of the above-described second embodiment are denoted by the same reference numerals and will not be described below.

As shown in FIG. 10A, a contact and separate mechanism according to the fifth embodiment includes a locking section 62, a metal pin 63, a spring receiving section 44, and a bias spring 46.

The locking section 62 contacts the heater 42 directly or via a heat conduction member. The locking section 62 is composed of a material with a high heat conductivity. The metal pin 63 is embedded in the locking section 62 and abuts against the back surface of the spring receiving section 44. The metal pin 63 is a displacement member that changes its shape in accordance with a temperature.

As shown in FIG. 10A, for ink cooling, the heater 42 is powered off, and the fan 36 is powered on. At this time, the heat sink 35 comes into tight contact with the heat exchange section 32. Thus, the heat of hot ink is conducted from the heat exchange section 32 to the heat sink 35 for radiation. The radiation cools the ink down to the desired ink temperature.

As shown in FIG. 10B, for ink heating, the heater 42 is powered on, and the cooling fan is powered off. At this time, the metal pin 63 is elongated by heat from the heater 42. The state in which the metal pin 63 is at the time will be referred to as the second state. The elongation allows the metal pin 63 to push up the spring receiving section 44. The push-out separates the heat sink 35 from the heat exchange section 32 to form an air layer between the heat sink 35 and the heat exchange section 31. The heat from the heater 42 efficiently heats ink without being radiated by the heat sink 35. The heating increases the temperature of the ink up to the desired value.

When the heater 42 is turned off, the temperature decreases, and the metal pin 63 shrinks. As a result, the metal pin 63 returns into the state shown in FIG. 10A. The state in which the metal pin 63 is at the time will be referred to as the first state.

As described above, according to the present embodiment, the metal pin 63 is elongated under the impact of the heat from the heater 42 or the temperature of another heat source. Thus, the heat sink 35 is separated from the heat exchange section 32. Consequently, the temperature of ink is efficiently adjusted.

FIG. 10A shows the single metal pin 63. However, of course, a plurality of metal pins 63 may be provided. Moreover, the metal pin 63 may be located near the support member 40, serving as a pivotal center for the heat sink 35.

Now, a sixth embodiment will be described.

Figure 11B:
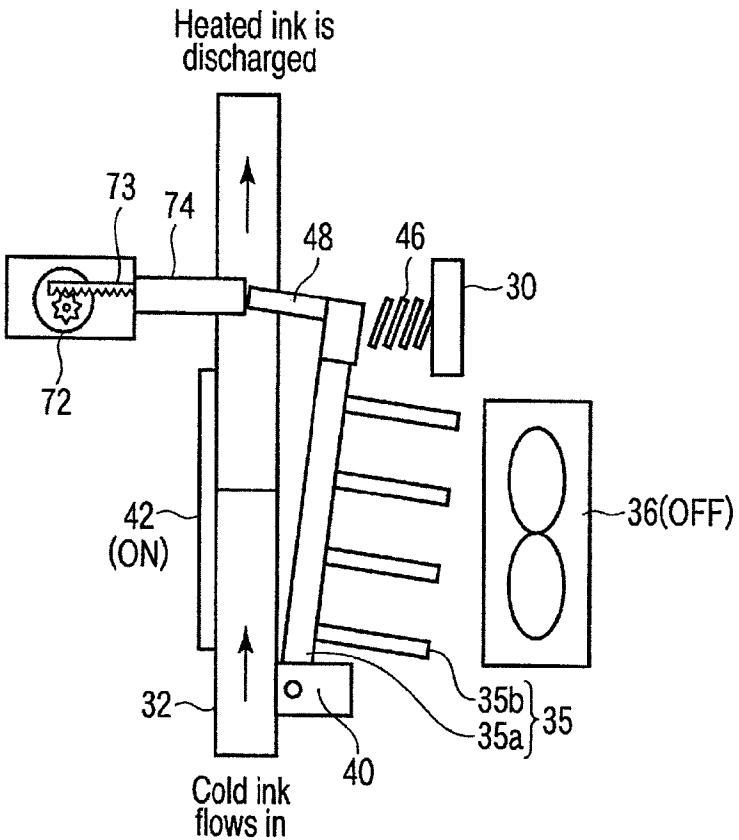
FIG. 11B is a diagram showing an operational condition in the configuration of the heat exchanger according to the sixth embodiment during heating.
Figure 11A:
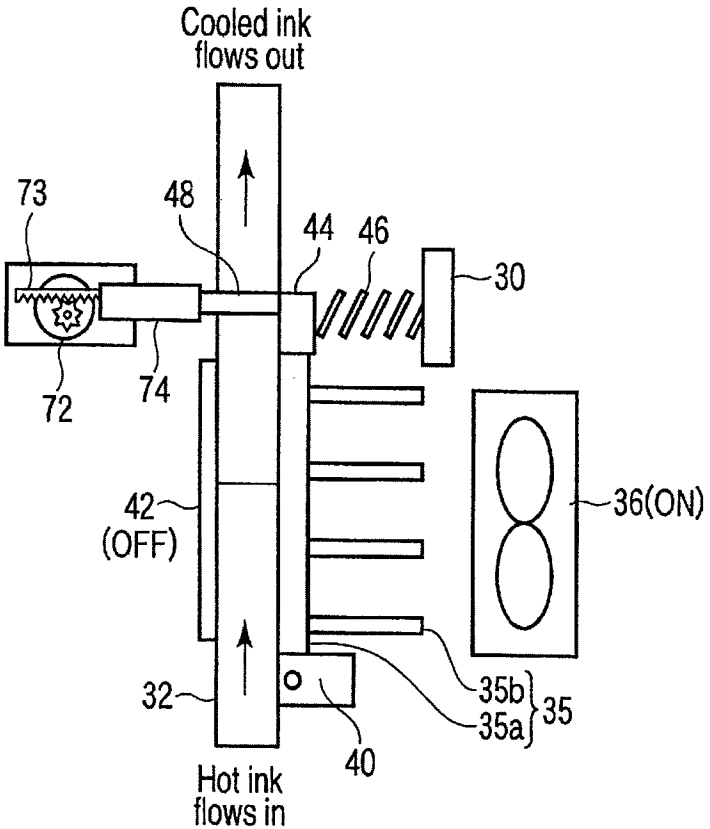
FIG. 11A is a diagram showing an operational condition in a configuration of a heat exchanger according to a sixth embodiment during radiation.

FIGS. 11A and 11B are diagrams showing the configuration of a heat exchanger according to the sixth embodiment. FIG. 11A shows an operational condition during radiation. FIG. 11B shows an operational condition during heating. Components of the present embodiment which are equivalent to those of the above-described second embodiment are denoted by the same reference numerals and will not be described below.

As shown in FIG. 11A, a contact and separate mechanism according to the sixth embodiment includes a rack and pinion mechanism 73 driven by a motor 72, a cylinder 74 connected to the rack and pinion mechanism 73, a spring receiving section 44, an interposition member 48, and a bias spring 46.

The motor 72 is driven according to the condition of a power source for the heater 42. That is, when the heater 42 is turned on, the motor 72 is rotated clockwise to allow the rack and pinion mechanism 73 to push out the cylinder 74. Thus, the cylinder 74 pushes up the spring receiving section 44 from the back surface to separate the heat sink 35 from the heat exchange section 32 (see FIG. 11B).

On the other hand, when the heater 42 is turned off, the motor 72 is rotated counterclockwise to allow the rack and pinion mechanism 73 to retract the cylinder 74. Thus, the heat exchange section 32 and the heat sink 35 come into tight contact with each other (see FIG. 11A).

As described above, according to the present embodiment, the rack and pinion mechanism 73 and the cylinder 74 separate the heat sink 35 from the heat exchange section 32. Thus, the temperature of ink is efficiently adjusted.

Various other driving sources such as an electromagnetic driving source using a coil and a magnet and a hydraulic cylinder source may be used to push out the cylinder 74.

Now, a seventh embodiment will be described.

Figure 12B:
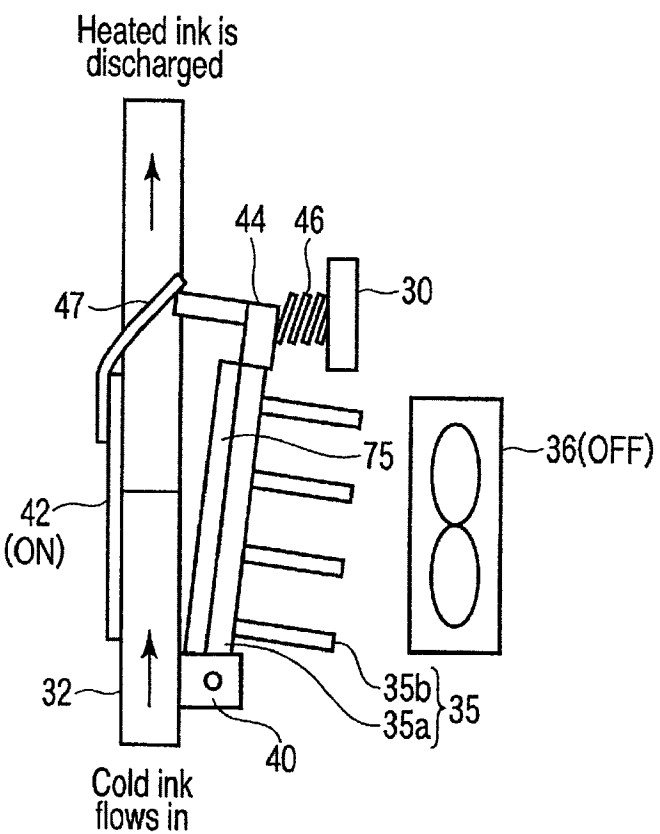
FIG. 12B is a diagram showing an operational condition in the configuration of the heat exchanger according to the seventh embodiment during heating.
Figure 12A:
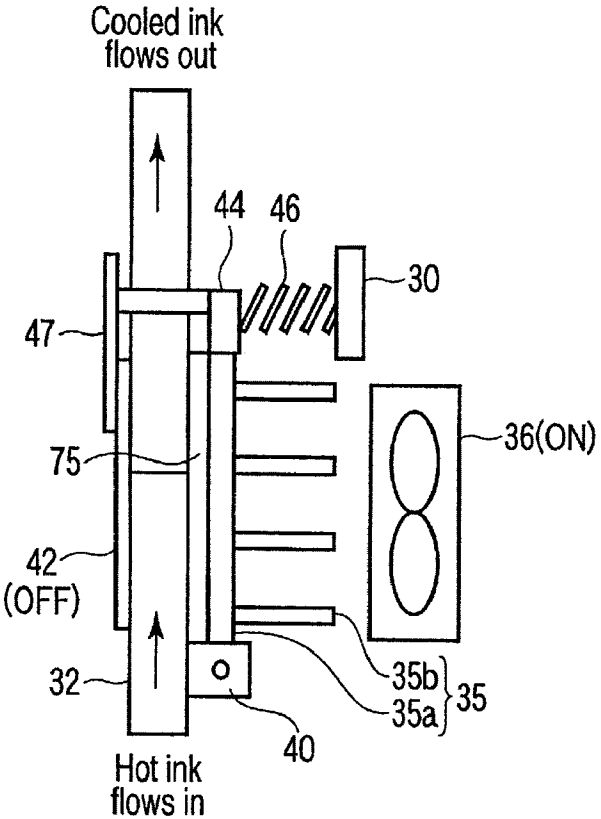
FIG. 12A is a diagram showing an operational condition in a configuration of a heat exchanger according to a seventh embodiment during radiation.

FIGS. 12A and 12B are diagrams showing the configuration of a heat exchanger according to the seventh embodiment. FIG. 12A shows an operational condition during radiation. FIG. 12B shows an operational condition during heating. Components of the present embodiment which are equivalent to those of the above-described second embodiment are denoted by the same reference numerals and will not be described below.

In the heat exchanger proposed in each of the above-described embodiments, even when the mounting of the heat exchange section 32 and the heat sink 35 is adjusted such that the heat exchange section 32 and the heat sink 35 are parallel to each other when tightly contacted with each other, a gap, though small, is created between the heat exchange section 32 and the heat sink 35 because of the flatness of each of the components. Gas (air) is present in the gap to affect the heat insulation.

According to the present embodiment, based on the heat exchanger in the above-described second embodiment, the gap between the heat exchange section 32 and the base material 35*a* is filled to improve the efficiency of heat exchange. To achieve this, the present embodiment includes a sheet 75 located between the heat exchange section 32 and the base material 35*a* and composed of an elastomer with a high heat transfer coefficient.

As shown in FIG. 12B, the sheet 75 is mounted on the base material 35*a* of the heat sink 35. When ink is cooled, the heat sink 35 and the heat exchange section 32 collapse the sheet 75. Thus, the gap between the two components is filled to eliminate the gas layer, improving the efficiency of heat exchange.

As described above, the present embodiment allows filling of the gap created between the heat exchange section 32 and the heat sink 35 when these components are tightly contacted with each other, thus eliminating the gas present in the gap. This enables an increase in the efficiency of heat exchange and thus in the efficiency of ink cooling based on radiation.

Now, a modification of the seventh embodiment will be described.

Figure 13B:
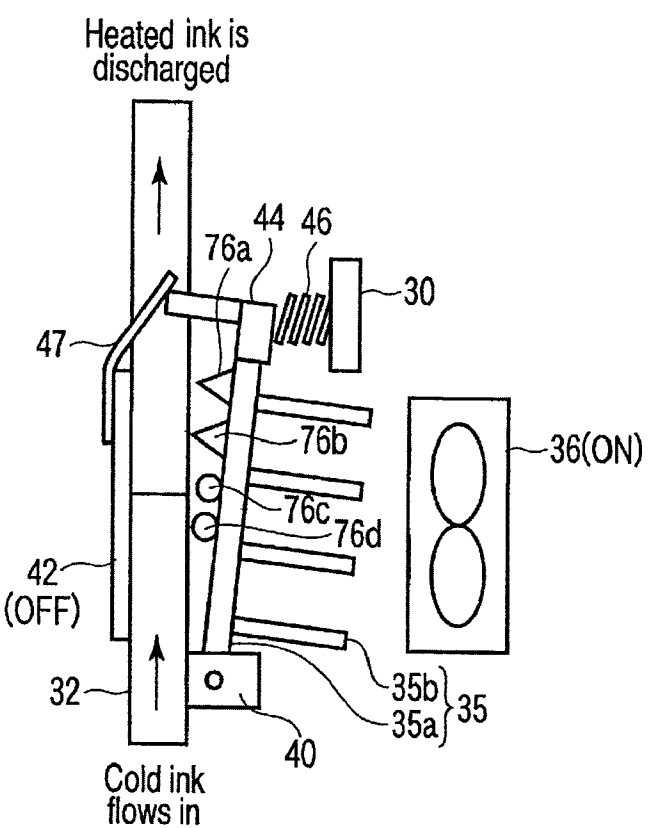
FIG. 13B is a diagram showing an operational condition in the configuration of the heat exchanger according to the modification of the seventh embodiment during heating.
Figure 13A:
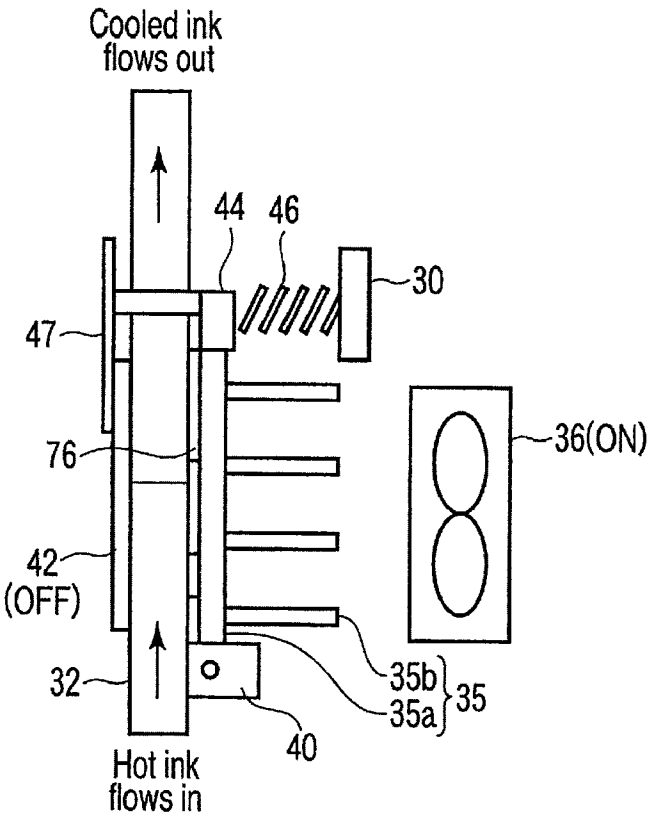
FIG. 13A is a diagram showing an operational condition in a configuration of a heat exchanger according to a modification of the seventh embodiment during radiation.

FIGS. 13A and 13B are diagrams showing the configuration of a heat exchanger according to the modification of the seventh embodiment. FIG. 13A shows an operational condition during radiation. FIG. 13B shows an operational condition during heating. Components of the present embodiment which are equivalent to those of the above-described seventh embodiment are denoted by the same reference numerals and will not be described below.

The present modification is an example of the modified shape of the above-described sheet 75. As shown in FIG. 13B, a sheet 76 is divided into four division sheets 76*a*, 76*b*, 76*c*, and 76*d*. In the normal condition, each of the division sheets is in point or line contact, at a certain position of the sheet, at least with the surface of the heat exchange section 32. The division sheet is preferably shaped like, for example, a prism, a pyramid, a cylinder, or a sphere.

For cooling, as shown in FIG. 13A, the heat sink 35 collapses the division sheets 76 so as to prevent a possible gap between the sheets.

As described above, the present modification allows filling of the gap created between the heat exchange section 32 and the heat sink 35 when these components are tightly contacted with each other, thus eliminating the gas present in the gap. This enables an increase in the efficiency of heat exchange and thus in the efficiency of ink cooling based on radiation. Furthermore, since the sheet is divided into the plurality of smaller sheets, defective division sheets can be individually replaced with new ones.

Now, an eighth embodiment will be described.

Figure 14B:
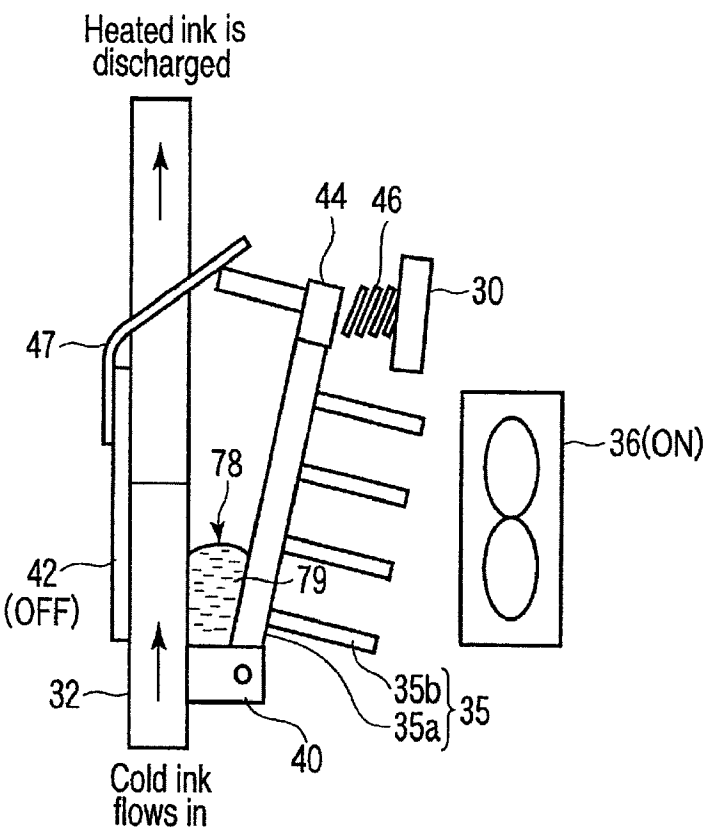
FIG. 14B is a diagram showing an operational condition in the configuration of the heat exchanger according to the eighth embodiment during heating.
Figure 14A:
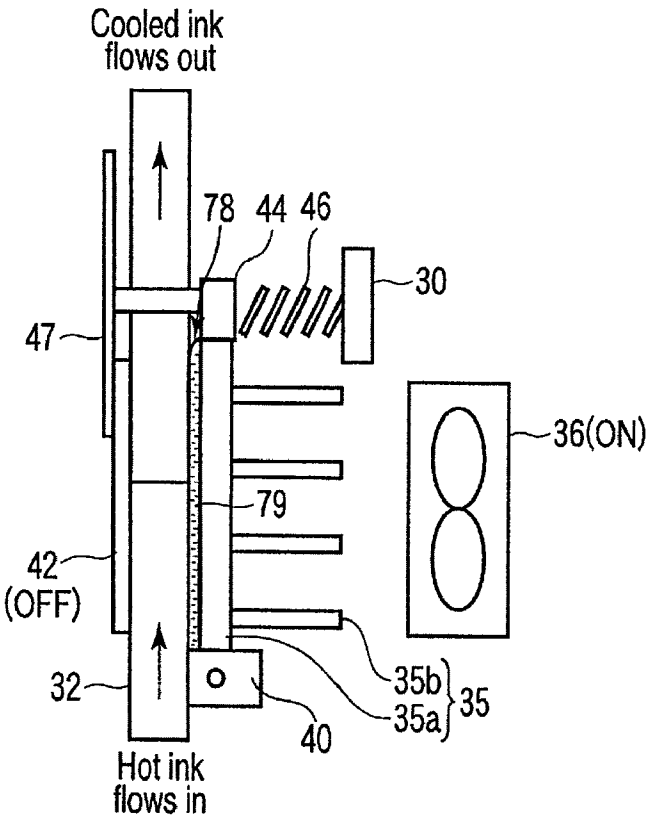
FIG. 14A is a diagram showing an operational condition in a configuration of a heat exchanger according to an eighth embodiment during radiation.

FIGS. 14A and 14B are diagrams showing the configuration of a heat exchanger according to the eighth embodiment. FIG. 14A shows an operational condition during radiation. FIG. 14B shows an operational condition during heating. Components of the present embodiment which are equivalent to those of the above-described seventh embodiment are denoted by the same reference numerals and will not be described below.

The present embodiment is an example in which instead of the sheet composed of the elastic member, a container 78 is used which has a jacket composed of a soft material and contains a fluid 79 with a high heat transfer coefficient. For radiation as shown in FIG. 14A, the heat exchange section 32 and the heat sink 35 are in tight contact with each other via the container 78 and the fluid 79. At this time, the container 78 and the fluid 79 fill the gap between the two components to eliminate the gas layer. Thus, the efficiency of ink heat exchange can be improved.

For heating as shown in FIG. 14B, the heat sink 35 separates from the heat exchange section 32. At this time, the container 78 sinks downward under the force of gravity. Thus, the area over which the container 78 contacts the heat exchange section 32 and heat sink 35 is reduced compared to that during radiation. Consequently, ink can be efficiently heated.

As described above, the present embodiment allows filling of the gap created between the heat exchange section 32 and the heat sink 35 when these components are tightly contacted with each other, thus eliminating the gas present in the gap. This enables an increase in the efficiency of heat exchange and thus in the efficiency of ink cooling based on radiation. Furthermore, the area over which the container 78 contacts the heat exchange section 32 and heat sink 35 is reduced compared to that during radiation. Consequently, ink can be efficiently heated.

Now, a ninth embodiment will be described.

Figure 15B:
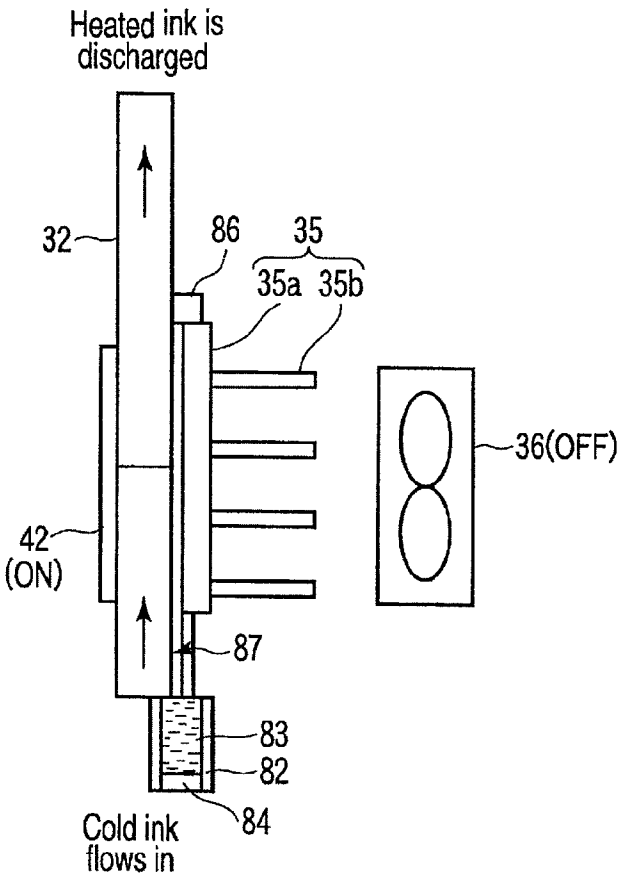
FIG. 15B is a diagram showing an operational condition in the configuration of the heat exchanger according to the ninth embodiment during heating.
Figure 15A:
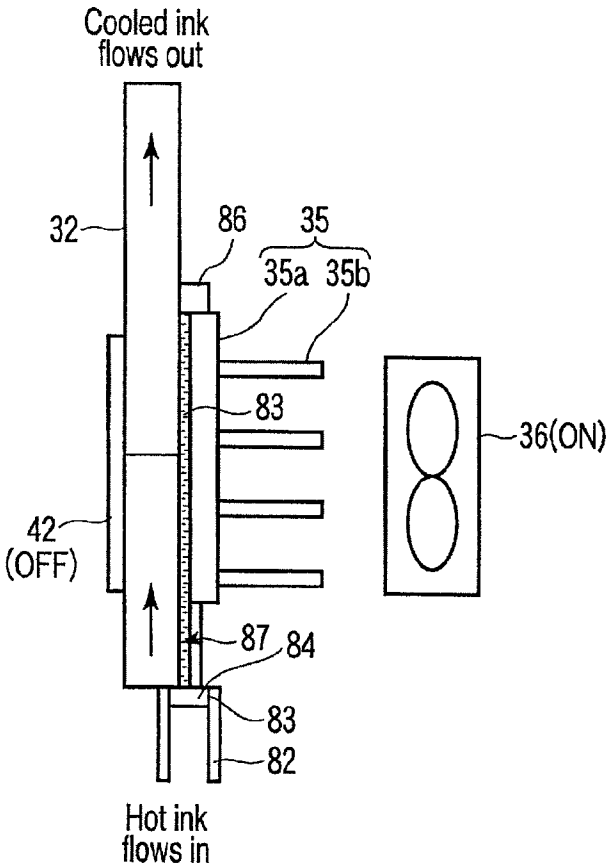
FIG. 15A is a diagram showing an operational condition in a configuration of a heat exchanger according to a ninth embodiment during radiation.

FIGS. 15A and 15B are diagrams showing the configuration of a heat exchanger according to the ninth embodiment. FIG. 15A shows an operational condition during radiation. FIG. 15B shows an operational condition during heating. Components of the present embodiment which are equivalent to those of the above-described first embodiment are denoted by the same reference numerals and will not be described below.

In the present embodiment, a secondary medium is allowed to flow into and out of a space (cavity) with a given interval formed between the heat sink 35 and the heat exchange section 32. This enables an increase and a reduction in the coefficient of heat transfer from the heat exchange section 32 to the heat sink 35. In the present embodiment, the secondary medium is a fluid (or a liquid) 87 with a high heat transfer coefficient.

As shown in FIG. 15A, the base material 35*a* of the heat sink 35, the thermal exchange section 32, and a closing member 86 form a closed space 87 between the base 35*a* and the heat exchange section 32. The closing member 86 closes the base material 35*a* and the heat exchange section 32 in three directions (in FIG. 15, the base material 35*a* and the heat exchange section 32 are closed on the top side and the opposite lateral sides).

A container 82 in which a fluid 83 is accommodated is provided under the space 87 in a liquid-tight manner. The bottom plate 84 of the container 82 can be moved up and down in a liquid-tight manner by a driving source (not shown in the drawings).

FIG. 15A shows that for cooling, a driving source (not shown in the drawings) pushes up the bottom plate 84. Thus, the fluid 83 inside the container 82 is pushed out to fill the inside of the space 87. The fluid 83 filled in the space 87 increases the conductivity of heat from the heat exchange section 32 to the heat sink 35.

Furthermore, as shown in FIG. 15B, for ink heating, the driving source pushes down the bottom plate 84. Thus, the fluid 83 inside the space 87 is returned to the container 82. That is, the space 87 is emptied to block the conductance of heat from the heat exchange section 32 to the heat sink 35. In the present embodiment, the container 82, the fluid 83, and the closing member 86, which forms the space 87, form a contact and separate mechanism.

As described above, the present embodiment is configured such that the secondary medium (fluid) 83 is allowed to flow into and out of the space 87 formed between the heat exchange section 32 and the heat sink 35. Thus, for ink cooling, the secondary medium 83 can be provided to increase the heat conductivity. For ink heating, a space can be formed between the heat exchange section 32 and the heat sink 35 to block the heat conduction.

Now, a tenth embodiment will be described.

Figure 16C:
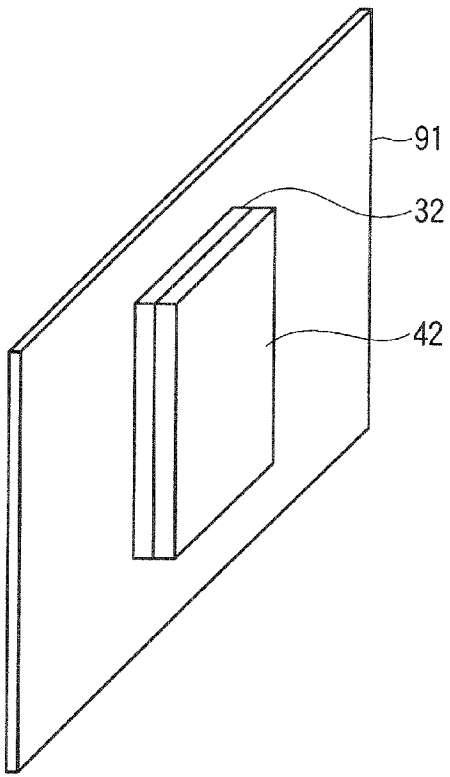
FIG. 16C is a diagram showing the external configuration of the heat exchanger according to the tenth embodiment.
Figure 16B:
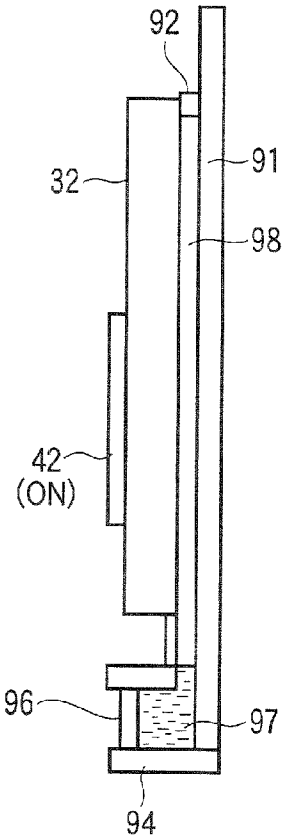
FIG. 16B is a diagram showing an operational condition in the configuration of the heat exchanger according to the tenth embodiment during heating.
Figure 16A:
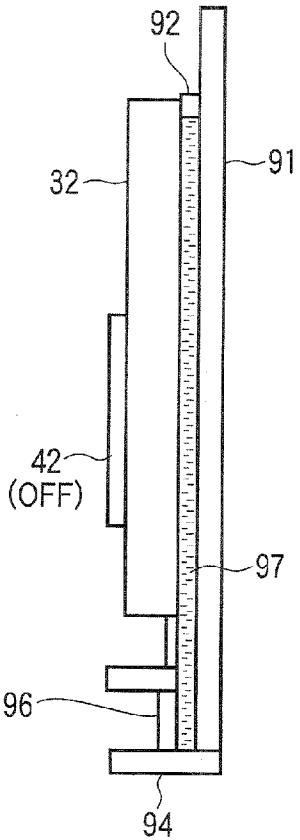
FIG. 16A is a diagram showing an operational condition in a configuration of a heat exchanger according to a tenth embodiment during radiation.

FIG. 16A to 16C are diagrams showing the configuration of a heat exchanger according to the tenth embodiment. FIG. 16A shows an operational condition during radiation. FIG. 16B shows an operational condition during heating. FIG. 16C is a diagram showing the external configuration of the heat exchanger.

The present embodiment is configured to allow a secondary medium (fluid) to flow into and out of the heat exchanger and to utilize an apparatus frame or a jacket plate to radiate heat to cool ink.

As shown in FIGS. 16A and 16C, a space 98 with a given interval is formed between the heat exchange section 32 and an apparatus frame 91. The space 98 is enclosed by a closing member 92 in three directions (in FIG. 16A, the space 98 is enclosed on the top side and the opposite lateral sides) so as to form a U shape.

A container 94 in which a secondary medium (fluid) 97 is accommodated is provided under the space 98 in a liquid-tight manner. Side plates 96 of the container 94 can be moved by a driving source (not shown in the drawings) in a horizontal direction in a liquid-tight manner.

For ink cooling as shown in FIG. 15A, when the driving source (not shown in the drawings) is used to push in the side plates 96, the internal fluid 97 is pushed out upward. Thus, the fluid 97 fills the inside of the space 98. The conductivity of heat from the heat exchange section 32 to the apparatus frame 91 is increased through the fluid 97 filled into the space 98. The heat is thus radiated.

Furthermore, for ink heating as shown in FIG. 15B, the driving source (not shown in the drawings) is used to draw out the side plate 96 back to the original position. The fluid 97 filled in the space 98 is drawn back and collected in the container 94. The collection empties the inside of the space 98 (gas is now present in the space) to block the conduction of heat from the heat exchange section 32 to the apparatus frame 91. The component for radiation may be, instead of the apparatus frame or jacket plate, a cover, if any, which covers the heat exchange section.

As described above, the present embodiment utilizes the apparatus frame or the jacket plate to provide the same function as that of radiation. This allows a separate radiation member to be omitted, enabling a reduction in costs. Furthermore, the present embodiment is configured so as to allow the secondary medium 97 to flow into and out of the space 98 formed between the heat exchange section 32 and the apparatus frame 91. For radiation for ink cooling, the secondary medium 97 can be provided to increase the heat conductivity. For ink heating, the space 98 can be formed between the heat exchange section 32 and the apparatus frame 91 to block the heat conduction.

What is claimed is:

1. An ink jet printer configured to perform image recording using ink of a plurality of colors, comprising:

ink heads provided in correspondence to the colors of the ink; and a heat exchanger configured to adjust a temperature of the ink supplied to the ink heads, wherein the heat exchanger includes:

a heat exchange section having ink flow paths which are formed therein in correspondence to the colors of the ink;

a heating section which is configured to heat the heat exchange section;

a heat radiation section which is configured to come into contact with the heat exchange section and to move away from the heat exchange section; and a contact and separate mechanism which is configured to bring the heat radiation section into contact with the heat exchange section when the heat radiation section radiates a heat of the heat exchange section, and to separate the heat radiation section from the heat exchange section and thereby form a heat conduction-blocking space between the heat radiation section and the heat exchange section, when the heating section heats the heat exchange section.

2. The ink jet printer according to claim 1, wherein the contact and separate mechanism comprises:

a bias member which biases the heat radiation section so that the heat radiation section tightly contacts the heat exchange section; and a displacement member which has a shape which changes depending on temperature, wherein during the heating, the shape of the displacement member is changed by heat from the heating section to separate the heat radiation section from the heat exchange section against a bias force of the bias member.

3. The ink jet printer according to claim 2, wherein the displacement member comprises a bimetal which bends in response to heat from the heating section, and the bimetal is bent to separate the heat radiation section from the heat exchange section against the bias force of the bias member.

4. The ink jet printer according to claim 2, wherein the displacement member comprises an elastic member containing gas which expands and contracts in response to heat from the heating section, and the gas allows the elastic member to expand to separate the heat radiation section from the heat exchange section against the bias force of the bias member.

5. The ink jet printer according to claim 2, wherein the heat radiation section comprises a heat sink having a plurality of fins, and the fins are extended in a direction in which the fins traverse the ink flow paths for the respective colors.

6. The ink jet printer according to claim 1, wherein the contact and separate mechanism comprises a cooling fan which blows air against the heat radiation section, and wherein, for the radiation, the cooling fan is driven to contact the heat radiation section with the heat exchange section by means of a wind force of the cooling fan, and for the heating, the driving of the cooling fan is stopped to separate the heat radiation section from the heat exchange section.

7. The ink jet printer according to claim 6, wherein the heat radiation section comprises a heat sink having a plurality of fins, and wherein one end side of the heat sink is supported so as to be pivotally movable with respect to the heat exchange section, and a balancer is provided on the other end side of the heat sink.

8. The ink jet printer according to claim 1, wherein the heat radiation section comprises:

a heat sink having which has a plurality of fins, one end side of the heat sink being supported so as to be pivotally movable with respect to the heat exchange section, and a bias member which abuts against the other end side of the heat sink, and which biases the heat sink in a direction in which the heat sink tightly contacts the heat exchange section.

9. The ink jet printer according to claim 1, wherein for the radiation, an elastomer with a high heat transfer coefficient is interposed between the heat exchange section and the heat radiation section.

10. The ink jet printer according to claim 9, wherein the elastomer is attached to the heat radiation section, and during the heating, the elastomer is in point or line contact with the heat exchange section.

11. The ink jet printer according to claim 1, wherein for the radiation, a fluid is interposed between the heat exchange section and the heat radiation section.

12. The ink jet printer according to claim 1, wherein the heat radiation section comprises a heat sink having a plurality of fins, and the fins are extended in a direction in which the fins traverse the ink flow paths for the respective colors.

13. The ink jet printer according to claim 1, wherein the contact and separate mechanism has:

a bias member which biases the heat radiation section so that the heat radiation section tightly contacts the heat exchange section; and a displacement member which changes from a first condition to a second condition in response to a rise in temperature, wherein, during the heating, heat from the heating section changes the shape of the displacement member from the first condition to the second condition to separate the heat radiation section from the heat exchange section against a bias force of the bias member, and during the radiation, the shape of the displacement member returns from the second condition to the first condition to tightly contact the heat radiation section with the heat exchange section under the bias force of the bias member.

14. The ink jet printer according to claim 13, wherein the heat radiation section comprises a heat sink having a plurality of fins, and the fins are extended in a direction in which the fins traverse the ink flow paths for the respective colors.

15. The ink jet printer according to claim 13, wherein the heat radiation section comprises a heat sink having a plurality of fins, wherein one end of the heat sink is supported so as to be pivotally movable with respect to the heat exchange section, and the other end of the heat sink is biased by the bias member.

16. The ink jet printer according to claim 15, wherein for the radiation, the fins are extended in a direction in which the fins traverse the ink flow paths for the respective colors.

17. The ink jet printer according to claim 13, wherein for the radiation, an elastomer with a high heat transfer coefficient is interposed between the heat exchange section and the heat radiation section.

18. The ink jet printer according to claim 17, wherein the elastomer is attached to the heat radiation section, and during the heating, the elastomer is in point or line contact with the heat exchange section.

19. An ink jet printer configured to perform image recording using ink of a plurality of colors, comprising:

ink heads provided in correspondence to the colors of the ink; and a heat exchanger configured to adjust a temperature of the ink supplied to the ink heads, wherein the heat exchanger includes:

a heat exchange section having ink flow paths which are formed therein in correspondence to the colors of the ink;

a heating section which is configured to come into tight contact with the heat exchange section and to heat the heat exchange section;

a heat radiation section which is located away from the heat exchange section, and which is configured to radiate heat from the heat exchange section;

a closing member which is configured to form a closed space between the heat exchange section and the heat radiation section; and a container which communicates with the closed space, and which contains a fluid; and wherein the fluid is supplied into the closed space when the heat radiation section radiates a heat of the heat exchange section, and the fluid is returned from the space into the container when the heating section heats the heat exchange section.

20. An ink jet printer for printing an image using a plurality of types of color ink, the ink jet printer comprising:

an ink circulation path in which a first tank, an ink jet head, and a second tank are connected to allow the color ink to circulate through the first tank, the ink jet head, and the second tank, and to return to the first tank, wherein between the first tank and the second tank there are arranged a heat exchange section which has ink channels formed independently therein for the respective ink colors, and a heat sink which tightly contacts the heat exchange section and which has a plurality of fins extending in a direction in which the fins traverse the ink channels for the respective colors.

* * * * *